US007886914B2

(12) United States Patent
Tanaka et al.

(10) Patent No.: US 7,886,914 B2
(45) Date of Patent: Feb. 15, 2011

(54) RECEIVED BANKNOTE PROCESSING APPARATUS

(75) Inventors: Yukiya Tanaka, Hyogo (JP); Osamu Ito, Hyogo (JP); Kozen Nakai, Hyogo (JP)

(73) Assignee: Glory Ltd., Hyogo (JP)

( * ) Notice: Subject to any disclaimer, the term of this patent is extended or adjusted under 35 U.S.C. 154(b) by 457 days.

(21) Appl. No.: 12/085,660

(22) PCT Filed: Dec. 1, 2005

(86) PCT No.: PCT/JP2005/022502

§ 371 (c)(1),
(2), (4) Date: May 29, 2008

(87) PCT Pub. No.: WO2007/063609

PCT Pub. Date: Jun. 7, 2007

(65) Prior Publication Data

US 2009/0166269 A1 Jul. 2, 2009

(51) Int. Cl.
*B07C 5/00* (2006.01)

(52) U.S. Cl. ..... 209/534; 209/3.1; 209/3.2; 209/552

(58) Field of Classification Search ..... 209/3.1, 209/3.2, 534, 552, 938; 340/674; 382/135; 194/206

See application file for complete search history.

(56) References Cited

U.S. PATENT DOCUMENTS

| | | | | |
|---|---|---|---|---|
| 4,747,492 | A * | 5/1988 | Saito et al. | 209/534 |
| 4,830,742 | A * | 5/1989 | Takesako | 209/534 |
| 5,966,456 | A * | 10/1999 | Jones et al. | 382/135 |
| 6,012,589 | A * | 1/2000 | Schulze | 209/534 |
| 6,771,180 | B2 * | 8/2004 | Mizuta et al. | 340/674 |

FOREIGN PATENT DOCUMENTS

| | | |
|---|---|---|
| JP | 59-184981 | 10/1984 |
| JP | 9-270042 | 10/1997 |
| JP | 2002-74464 | 3/2002 |
| JP | 2003-242549 | 8/2003 |

OTHER PUBLICATIONS

International Search Report mailed Mar. 14, 2006 for International Application No. PCT/JP2005/022502.

* cited by examiner

*Primary Examiner*—Terrell H Matthews
(74) *Attorney, Agent, or Firm*—Wenderoth, Lind & Ponack, L.L.P.

(57) ABSTRACT

A received banknote processing apparatus having no temporary reserving section has a failure recovery processing unit. The failure recovery processing unit securely recovers the number of banknotes of an accepted transaction together with the determination of the fitness of the banknotes of the accepted transaction in failure recovery processing that is performed when a failure, such as a jam, occurs.

10 Claims, 8 Drawing Sheets

RECEIVED BANKNOTE PROCESSING APPARATUS

TECHNICAL FIELD

The present invention relates to a received banknote processing apparatus for discriminating the denominations and the damaged state of the banknotes of each money receiving transaction and counting the number of the banknotes, as well as accommodating them to stackers (accommodation section), according to the discriminated denominations and the ranks of degree of the damaged state. More specifically, the present invention relates to a received banknote processing apparatus capable of securely classifying the data of the transaction whose processing is accepted and the data of the transaction whose processing is not accepted even if a failure, such as a jam, of the banknotes occurs when banknote reception processing is performed to a plurality of transactions regardless of whether the received banknote processing apparatus has a simple arrangement without a temporary reserving section for temporary reserving the banknotes especially before accommodating them.

BACKGROUND ART

Most of received banknote processing apparatuses ordinarily employ a temporary reserving section so that banknotes are accommodated in an accommodation section after it is confirmed that the transaction of the banknotes is accepted by temporarily reserving them in the temporary reserving section. There is an apparatus disclosed in, for example, U.S. Pat. No. 4,747,492 of the applicant, as a received banknote processing apparatus including the temporary reserving section. The apparatus disclosed in the U.S. Pat. No. 4,747,492 includes stackers (S1 to S6) which accommodate banknotes after they are sorted according to the denominations thereof and to the upper portions of which temporary reserving sections (SH1 to SH6) are disposed.

A plurality of banknote receiving transactions are continuously processed by the above apparatus as described below.

First, when the received banknotes of an initial transaction are supplied to a hopper, the denominations of the banknotes fed from the hopper are discriminated by a denomination discrimination section, and the banknotes are transported to the temporary reserving sections (SH1 to SH6) disposed to the upper portion of the stackers (S1 to S6) for respective denominations according to denominations thereof. Then, the detail of the received banknotes is checked against a result of processing performed by the apparatus, and when they agree with each other, the banknotes are released from the temporary reserving sections (SH1 to SH6) and sequentially accommodated in the stackers (S1 to S6) by depressing a banknote reception accepting button. Second and subsequent banknote receiving transactions are also processed likewise, and even if a failure such as a jam and the like occurs while, for example, a second banknote receiving transaction is being performed, since only the banknotes of the second transaction exist in the temporary reserving sections (SH1 to SH6), they are not mixed with the banknotes of the initial transaction.

Accordingly, as a failure recovery processing of the apparatus in which a failure occurs, it is sufficient to supply the banknotes reserved in the temporary reserving sections (SH1 to SH6), the banknotes remaining in the hopper, and the banknotes located on a transport path in which the jam occurs to the hopper again together so that they are processed.

In contrast, there are available many received banknote processing apparatuses which have a simple structure without temporary reserving sections to make the cost of the apparatus less expensive. In the received banknote processing apparatus having no such temporary reserving sections, when a plurality of banknote receiving transactions are continuously processed and a failure, such as a jam or the like, occurs while a second or subsequent transaction is being processed, troublesome failure recovery processing occurs. When it is assumed, for example, that a initial banknote receiving transaction is normally processed, and a failure, such as a jam or the like, occurs while a second banknote receiving transaction is being performed, the banknotes of the first accepted transaction, and the banknotes of the second transaction which is not accepted and being processed, are mixedly accommodated in the state of accommodating the banknotes in the respective stackers. To perform processing for recovering from the above failure, it is necessary to take out all of the mixed banknotes from the stackers, as well as to gather the banknotes remaining in the hopper and the banknotes located on the transport path in which the jam occurred, to have the operator manually count the banknotes, and to separate the banknotes of the first accepted transaction.

Accordingly, when a failure occurs in the received banknote processing apparatus without the temporary reserving sections, a recovery job of the apparatus is very troublesome, and there is a possibility that banknotes are erroneously processed. As described above, it is effective to provide the received banknote processing apparatus with the temporary reserving sections to promptly and accurately recover from a failure occurring in the apparatus when a plurality of banknote receiving transactions are continuously processed. However, provision of the temporary reserving sections is disadvantageous in that the mechanism of the apparatus becomes complex, as well as increasing the cost thereof.

Further, the received banknote processing apparatus which is not provided with the temporary reserving sections to reduce cost has a problem in that recovery processing when a failure, such as a jam or the like, occurs is very troublesome and there is a possibility that banknotes are erroneously processed.

To overcome the above problems, the applicant already proposed a received banknote processing apparatus arranged simply by providing no temporary reserving section to reduce cost and to make it unnecessary to manually separate the banknotes of an accepted transaction even if a failure, such as a jam or the like, occurs (refer to Japanese Patent Application Laid-Open No. 2002-74464 A).

On the other hand, users of received banknote processing apparatuses have needs for ranking banknotes which are subjected to reception processing according to a damaged state and accommodating the banknotes after they are sorted to banknotes suitable for reuse (hereinafter, called "usable banknote") and banknotes unsuitable for reuse (hereinafter, called "damaged banknote").

There is already proposed a damaged banknote extraction apparatus and a cash handling apparatus including the damaged banknote extraction apparatus which meet these needs (refer to Japanese Patent Application Laid-Open No. 2003-242549 A). However, even if these apparatuses are used, a result of the determination lacks reproducibility in the vicinity of the threshold value of criterion of a fitness determination. That is, it is assumed that a plurality of banknote receiving transactions are continuously processed, and a failure, such as a jam or the like, occurs while a second or subsequent banknote reception transaction is being performed. In this case, when, for example, an initial banknote receiving transaction is normally processed and the failure, such as the jam or the like, occurs while the second banknote reception transaction is being processed, the banknotes of the first accepted transaction and the banknotes of the second transaction, which have not been accepted and are being processed, are mixedly accommodated in the respective stackers. To cope with the above problem, all of the banknotes located in the respective stackers are collected and placed on the hopper again, the denominations and the fitness of the banknotes are determined again, only the accepted banknotes of the initial transaction are accommodated in the respective stackers, and the other banknotes are transported to a reject section. However, since the determination of fitness lacks the reproducibility described above, there is a possibility that a result of the determination is different from a previous result of the determination, from which a problem arises in that processing is finished regardless of whether or not that the accepted number of the banknotes of the initial transaction is reached.

SUMMARY OF THE INVENTION

Problems to be Solved by the Invention

An object of the present invention, which was made in view of the problems described above, is to provide a received banknote processing apparatus which can securely recover the accepted number of banknotes of an accepted transaction including the fitness determination in failure recovery processing performed when a failure, such as a jam or the like, occurs in a received banknote processing apparatus that is not provided with a temporary reserving section.

Means for Solving the Problem

The present invention relates to a received banknote processing apparatus for performing banknote reception processing by sequentially separating and feeding one by one the banknotes of each banknote receiving transaction placed on a hopper. A received banknote processing apparatus according to a first embodiment of the present invention for achieving the above object includes a denomination discrimination means for discriminating the denominations of the banknotes, a fitness determination means for determining whether the banknotes are usable banknotes or damaged banknotes, a count means for counting the number of the banknotes having the respective discriminated denominations and determined fitness, a memory means for storing the counted number of the banknotes having the respective discriminated denominations, the counted number of the banknotes that are determined as the usable banknotes, and the counted number of the banknotes that are determined as the damaged banknotes, a plurality of stackers for accommodating the counted banknotes having the respective denominations, the usable banknotes, and the damaged banknotes of the counted banknotes, a failure detection means for detecting the occurrence of a failure while the banknote reception processing is being performed, an information means for informing that the failure is detected by the failure detection means, a failure recovery processing means for recovering the numbers of accommodation of banknotes of the stackers to the numbers accepted until the banknote reception processing before the present banknote reception processing, during which the failure occurred, and a recovery mode switching means for starting the failure recovery processing means, wherein when the occurrence of the failure is informed by the information means while the banknotes of second and subsequent banknote receiving transactions are being subjected to the banknote reception processing, all the banknotes accommodated in the respective stackers are actually placed on the hopper again by an operator while keeping the sequence in which the banknotes are stacked, and the failure recovery processing means is started by operating the recovery mode switching means, the failure recovery processing means sequentially separates and feeds one by one all the banknotes placed on the hopper again, discriminates the denominations of the banknotes, determines fitness, accommodates the banknotes discriminated by denomination and determined by fitness in the original stackers respectively, and counts the number of the accommodated banknotes, and when the number of the banknotes accommodated in any one of the stackers reaches the accepted number of the banknotes accommodated in the stacker which is stored to the memory means, the banknotes having the same denomination as that of the banknotes that are accommodated in the stacker and the number of which reaches the accepted number, are accommodated in another stacker allocated to the denomination regardless of the result of the fitness determination, and when the number of the banknotes accommodated in the other stacker reaches the accepted number of the other stacker stored to the memory means, the remaining banknotes having the same denomination as the above denomination are accommodated in a stacker allocated to usable banknotes having the denomination and in a stacker allocated to damaged banknotes having the denomination according to the result of the fitness determination, and failure recovery processing is performed by repeating the above processing for all of the denominations.

Further, a received banknote processing apparatus according to a second embodiment of the present invention for achieving the above object includes a denomination discrimination means for discriminating the denominations of the banknotes, a fitness determination means for determining whether the banknotes are usable banknotes or damaged banknotes, a count means for counting the number of the banknotes having the respective discriminated denominations, the number of the banknotes which are determined as the usable banknotes, and the number of the banknotes which are determined as the damaged banknotes, a memory means for storing the counted number of the banknotes having the respective discriminated denominations, the counted number of the banknotes which are determined as the usable banknotes, and the counted number of the banknotes which are determined as the damaged banknotes, a plurality of usable banknote stackers disposed for respective denominations, only one damaged banknote stacker for accommodating only damaged banknotes regardless of the denominations thereof, a reject stacker for accommodating the banknotes which are rejected under a predetermined condition, failure detection means for detecting the occurrence of a failure while the banknote reception processing is being performed, an information means for informing that the failure is detected by the failure detection means, a failure recovery processing means for recovering the numbers of banknotes accommodated in the usable banknote stackers and the damaged banknote stackers to the accepted numbers just before the failure occurs, and a recovery mode switching means for starting up the failure recovery processing means, wherein when the occurrence of the failure is informed by the information means while the banknotes of second and subsequent banknote receiving transactions are being subjected to the banknote reception processing, all the banknotes accommodated in the usable banknote stackers actually are collectively placed on the hopper again by an operator, and when the failure recovery processing means is started up by operating the recovery mode switching means, the failure recovery processing means sequentially separates and feeds one by one all the banknotes placed on the hopper again, discriminates the denominations of the banknotes, and determines fitness, accommodates the banknotes determined the denominations in the usable banknote stackers of the respective denominations as the usable banknotes regardless of the result of the fitness determination, and counts the number of the accommodated banknotes, when the number of the banknotes accommodated in the usable banknote stacker of any one of the denominations reaches the accepted number of the banknotes accommodated in the usable banknote stacker which is stored to the memory means, the failure recovery processing means performs first processing to all the banknotes placed again to accommodate the banknotes having the same denomination as the denomination of the banknotes whose number reaches the accepted number in the reject stacker regardless of the result of the fitness determination, when all the banknotes accommodated in the damaged banknote stacker are collectively placed again on the hopper by the operator subsequent to the first processing, the failure recovery processing means sequentially separates and feeds one by one all the banknotes placed on the hopper again, discriminates the denominations of the banknotes, determines the fitness, accommodates the banknotes determined by denominations in the damaged banknote stacker as the damaged banknotes regardless of the result of the fitness determination, and counts the number of the accommodated banknotes of the respective denominations, and when the number of the banknotes accommodated in the damaged banknote stacker reaches the accepted numbers, which are stored to the memory, of the damaged banknotes of the respective denominations accommodated in the damaged banknote stacker, the failure recovery processing means performs second processing to accommodate the banknotes having the same denomination as the denomination of the banknotes whose number reaches the accepted number in the reject stacker regardless of the result of the fitness determination to thereby perform failure recovery processing.

BEST MODE FOR CARRYING OUT THE INVENTION

Figure 1:
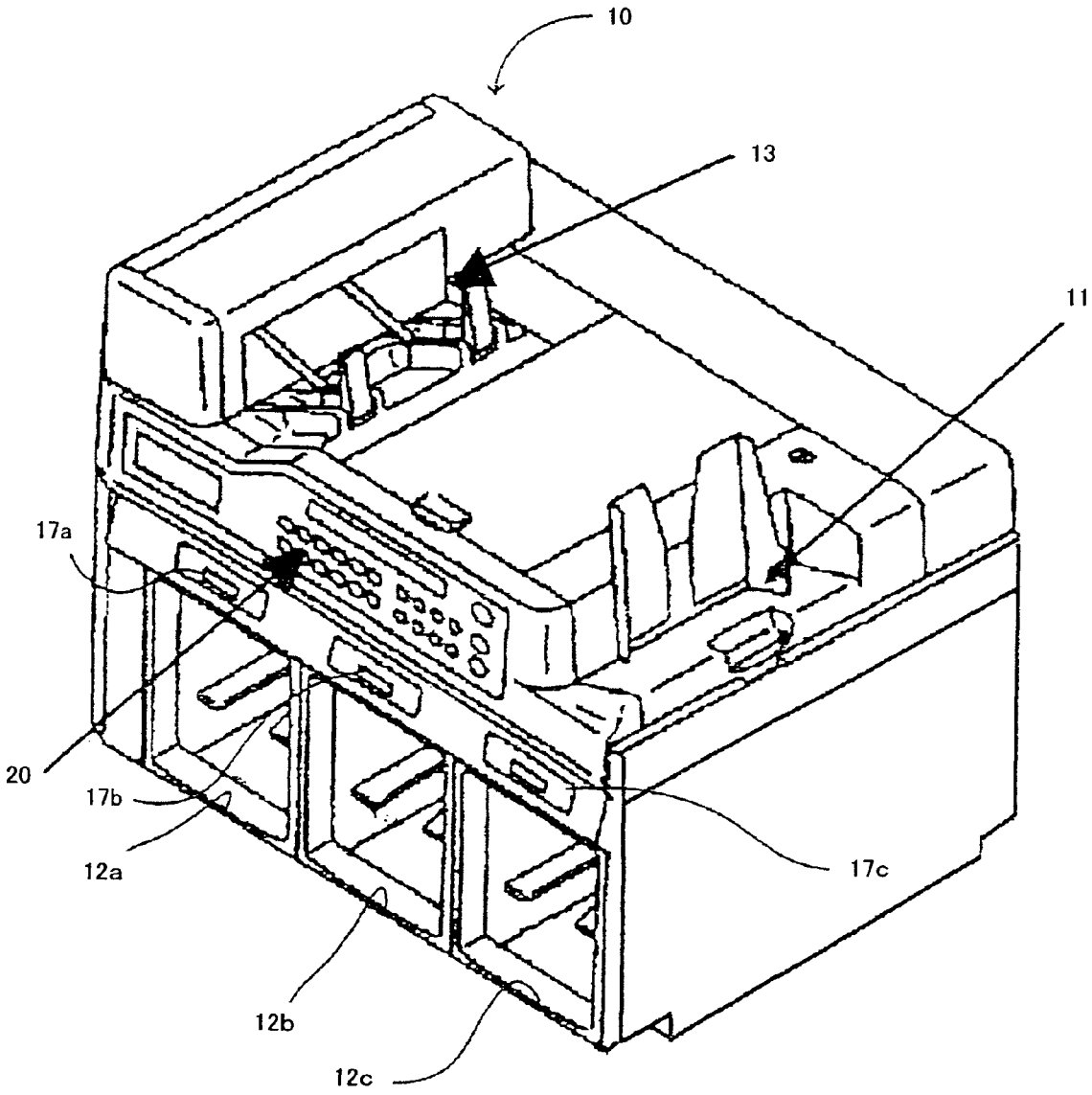
FIG. 1 is an appearance view showing an embodiment of a received banknote processing apparatus according to the present invention.

A received banknote processing apparatus of the present invention will be specifically explained below referring to the drawings.

FIG. 1 shows an appearance of an embodiment of the received banknote processing apparatus 10 of the present invention. A hopper 11, on which banknotes to be subjected to banknote reception processing are placed, is disposed to the upper portion of a main body, and a display/operation section 20 is disposed on a front panel to display necessary data and to input and instruct processing and the like. Further, a plurality of stackers 12 (12*a* to 12*c*) are partitioned and disposed to the lower portion of the main body to accommodate the banknotes whose denominations are discriminated according to the denominations thereof, and a reject stacker 13 is disposed to an end of the upper portion of the main body to discharge and stack rejected banknotes. Stacker LEDs 17 (17*a* to 17*c*) are disposed above the stackers 12*a* to 12*c* in correspondence thereto to display the number of the banknotes accommodated in the respective stackers 12*a* to 12*c* and can be continuously or intermittently lit. Further, the stackers 12 have a structure for permitting the banknotes accommodated therein to be removed by hand. Note that although only three stackers are displayed in the example, it is possible to increase the number of the stackers by coupling additional stackers with them.

Figure 2:
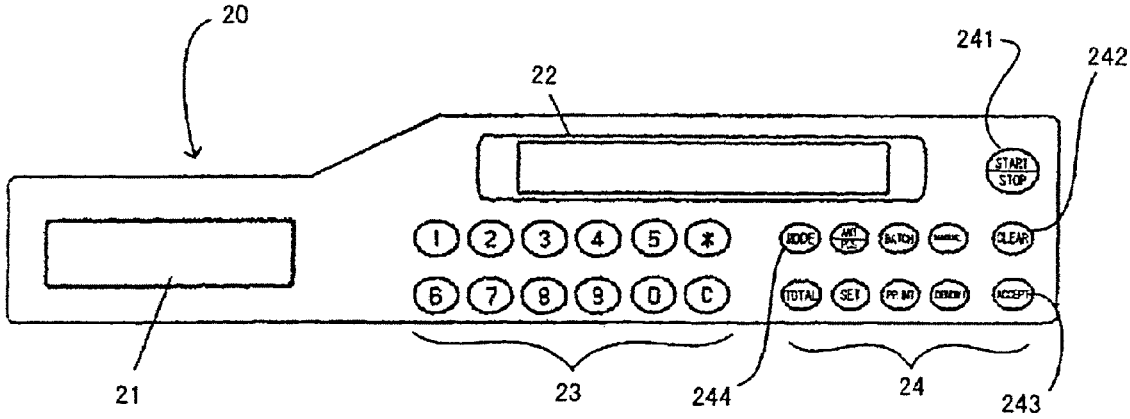
FIG. 2 is a view showing an embodiment of a display/operation section.

FIG. 2 shows the display/operation section 20 in detail. The display/operation section 20 is composed of a liquid crystal display section 21 for displaying a time, an error code, and the like, an LED display section 22 composed of an LED for displaying discriminated denominations and count data, ten-keys 23 for inputting numeral data, and operation keys 24 for instructing manipulation. The operation keys 24 include a "START/STOP" key 241 for instructing the starting and stopping of an operation, a "CLEAR" key 242 for instructing the clearing of data, an "ACCEPT" key 243 for instructing the accepting of an input, a "MODE" key 244 for instructing the selection of switching to a failure recovery processing mode, and the like.

Figure 3:
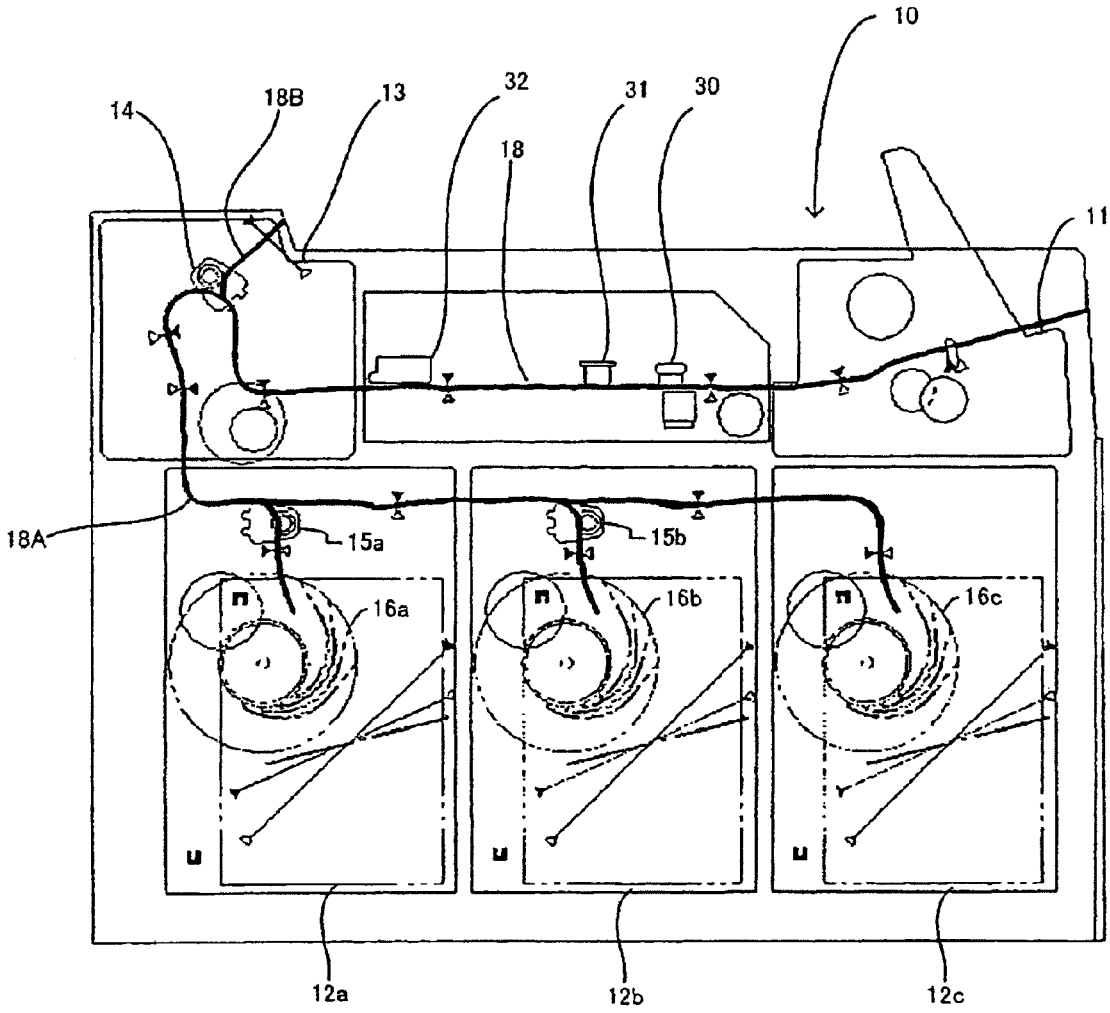
FIG. 3 is a side sectional structure view showing an embodiment of the received banknote processing apparatus according to the present invention.

Further, FIG. 3 shows a sectional structure of the received banknote processing apparatus 10 when it is viewed from a side surface thereof. A denomination discrimination means 30, a fitness determination means 31, and a count means 32 are disposed to a transport path 18 between the hopper 11 and the reject stacker 13. A diverter plate 14 is disposed to the transport path 18 of the reject stacker 13 to divert a banknote being transported to a transport path 18A disposed above the stackers 12 and to a transport path 18B to the reject stacker 13. Diverter plates 15 (15*a* and 15*b*) are disposed to the transport path 18A above the stackers 12 in correspondence to the respective stackers 12 to discharge banknotes downward and to divert and stack them to and on the respective stackers 12. Vane wheels 16 (16*a* to 16*c*) are disposed to the stackers 12 to align and stack the banknotes discharged from the transport path 18A, and various types of sensors are disposed to the transport paths 18, 18A, and 18B to optically detect that banknotes pass therethrough. Note that although only the three stackers are displayed in the example of FIG. 3, the number of them can be increased by coupling additional stackers therewith.

Figure 4:
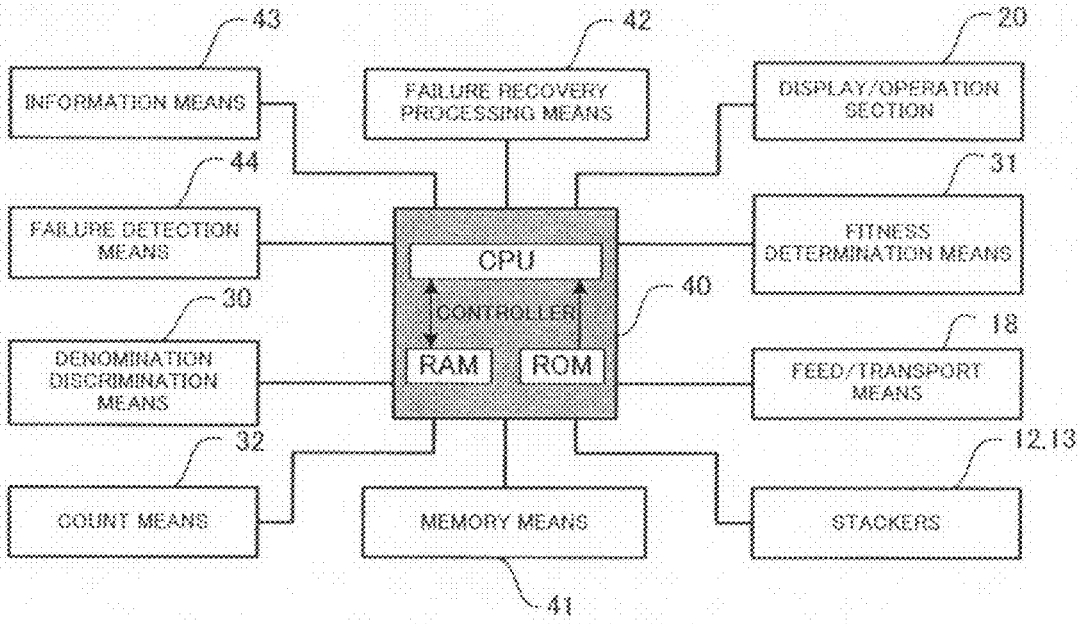
FIG. 4 is a block diagram showing an example of internal arrangement of the received banknote processing apparatus according to the present invention.

FIG. 4 shows an internal arrangement of the received banknote processing apparatus 10, a memory means 41 is connected to a controller 40 composed of a CPU and the like to control the received banknote processing apparatus 10 in its entirety, and the display/operation section 20, the denomination discrimination means 30, the fitness determination means 31, and the count means 32 are also connected to the controller 40. Further, a failure recovery processing means 42 and an information means 43 are also connected to the controller 40, and a failure detection means 44 is also connected thereto to detect a failure such as a jam and the like. In addition to the above, a feed/transport means 18 and the respective stackers 12, 13 are also controlled by the controller 40.

The fitness determination means refers to a means for determining whether a banknote can be reused (usable banknote) or cannot be reused (damaged banknote) according to a damaged state of it, and a means disclosed in, for example, Japanese Patent Application Laid-Open No. 2003-242549 can be used.

The failure detection means 44 detects the occurrence of a failure while a banknote receiving transaction is being performed, and when the failure detection means 44 detects the occurrence of the failure, it operates the information means 43 through the controller 40. The information means 43 sounds a buzzer (not shown), displays an alarm on the liquid crystal display section 21 and the LED display section 22 of the display/operation section 20 so that it can be visually observed, or blinks the number displays of the stacker LEDs 17. Further, the controller 40 controls the denomination discrimination means 30, the fitness determination means 31, and the count means 32, as well as discriminates the denominations of banknotes, determines fitness, and counts the number of the banknotes. Further, the controller 40 controls the various types of sensors and processes the signals therefrom and further controls the diverter plates 14 and 15 and the vane wheels 16. The memory means 41 stores the data such as the denominations of the banknotes of an accepted banknote receiving transaction, a result of fitness determination, the number of the banknotes and the like.

Figure 5:
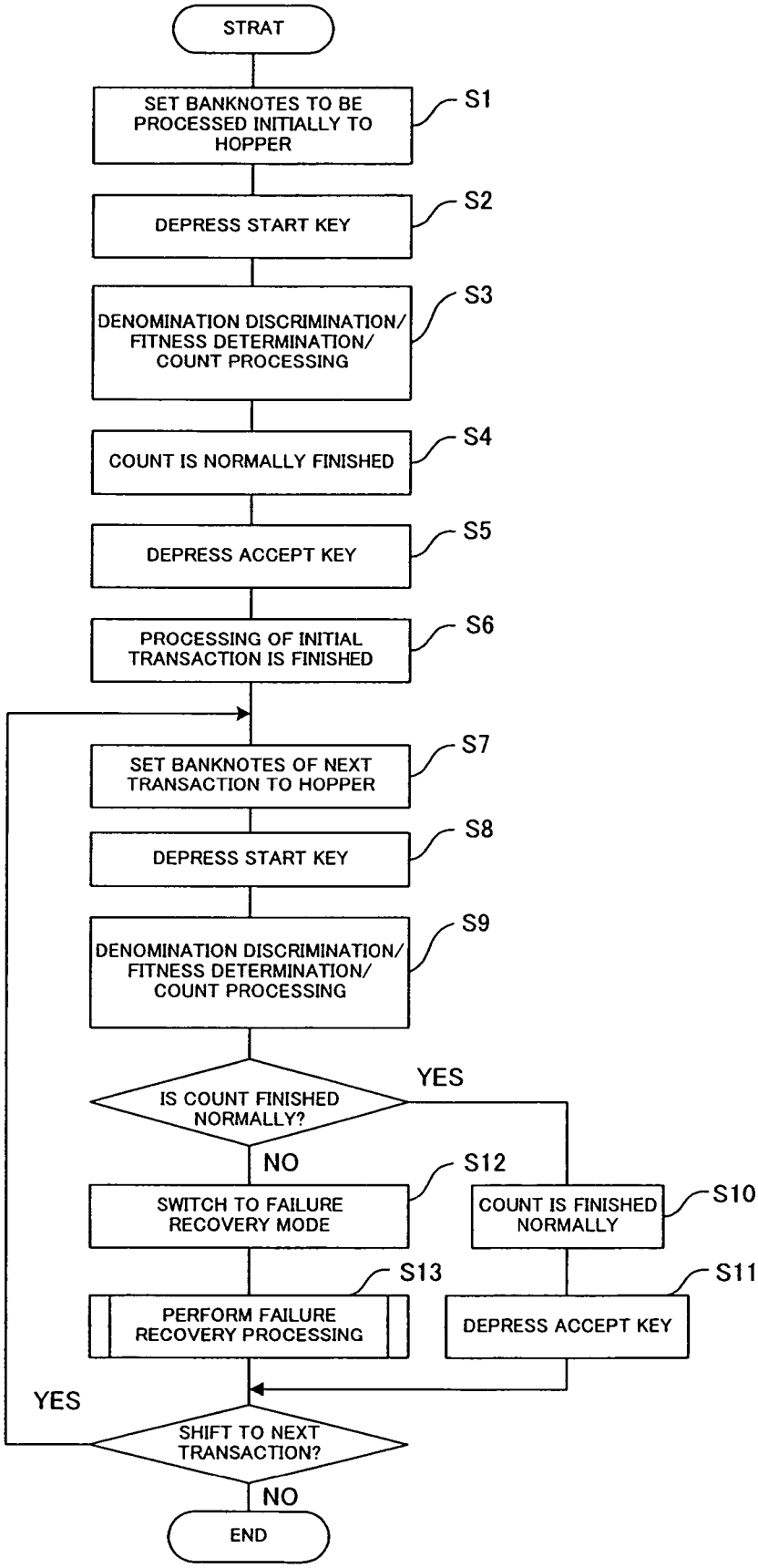
FIG. 5 is a flowchart showing a flow of banknote reception processing of the received banknote processing apparatus according to the present invention.

An operation of ordinary banknote reception processing in the above arrangement will be explained referring to a flowchart of FIG. 5.

First, when the banknotes of a banknote receiving transaction to be processed initially are set to (placed on) the hopper 11 (Step S1) and the "START/STOP" key 241 of the display/operation section 20 is depressed (Step S2), the banknotes placed on the hopper 11 are separated one by one and fed inward of the apparatus 10 along the transport path 18, transported to the denomination discrimination means 30, the fitness determination means 31, and the count means 32, subjected to banknote denomination discrimination processing, fitness determination processing, and count processing, and accommodated in the respective stackers (Step S3). When a series of the banknote reception processing is finished normally, it is displayed on the LED display section 22 (Step S4), and an operator, who views it, depresses the "ACCEPT" key 243 of the display/operation section 20 (Step S5), thereby the processing of the initial transaction is finished (Step S6). Note that before the operator depresses the "ACCEPT" key 243, he or she determines whether or not the banknote reception processing is normally performed by checking the displays of the display/operation section 20 and the stacker LED 17 against a slip showing the details of the banknote receiving transaction. When it is determined that the banknote reception processing is normally performed, the operator depresses the "ACCEPT" key 243, thereby count data is accepted and stored to the memory means 41.

Likewise, banknotes to be processed next are set to (placed on) the hopper 11 (Step S7). At the time, the banknotes received in the previous transaction (first transaction) remain accommodated in the stackers 12. When the operator depresses "the START/STOP" key 241 of the display/operation section 20 (Step S8), the banknotes placed on the hopper 11 are transported to the denomination discrimination means 30, the fitness determination means 31, and the count means 32 and subjected to the banknote denomination discrimination processing, the fitness determination processing, and the count processing (Step S9). Next, whether or not the banknote denomination discrimination processing and the count processing are normally performed are determined by checking the result of the processing against a slip showing the details of the second transaction, and when the processing is normally performed, the second transaction is finished (Step S10), and count data is accepted by depressing the "ACCEPT" key 243 (Step S11). When there is a next transaction, the process returns to the Step S7 and processes the transaction, whereas when there is no next transaction, the process is finished. In contrast, when a failure such as a jam and the like occurs while the banknotes are being transported, since the apparatus issues an alarm and is automatically stopped, the operator switches an operation mode to a failure recovery mode in the display/operation section 20 (Step S12), and starts up the failure recovery processing means. It is preferable to previously set the failure recovery mode to the "MODE" key of the display/operation section.

Figure 7:
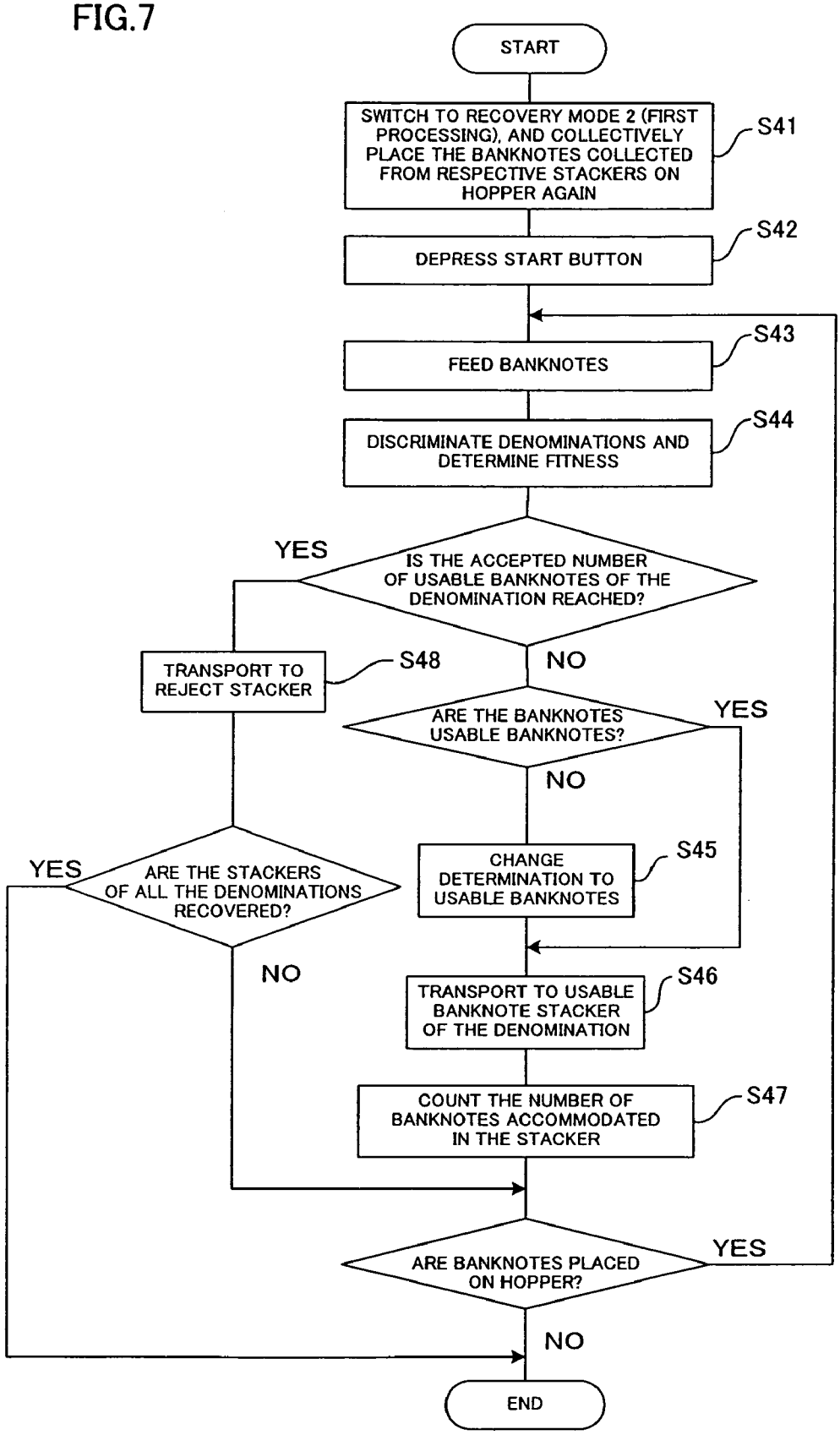
FIG. 7 is a flowchart showing another embodiment (first processing) of the failure recovery processing according to the present invention.
Figure 8:
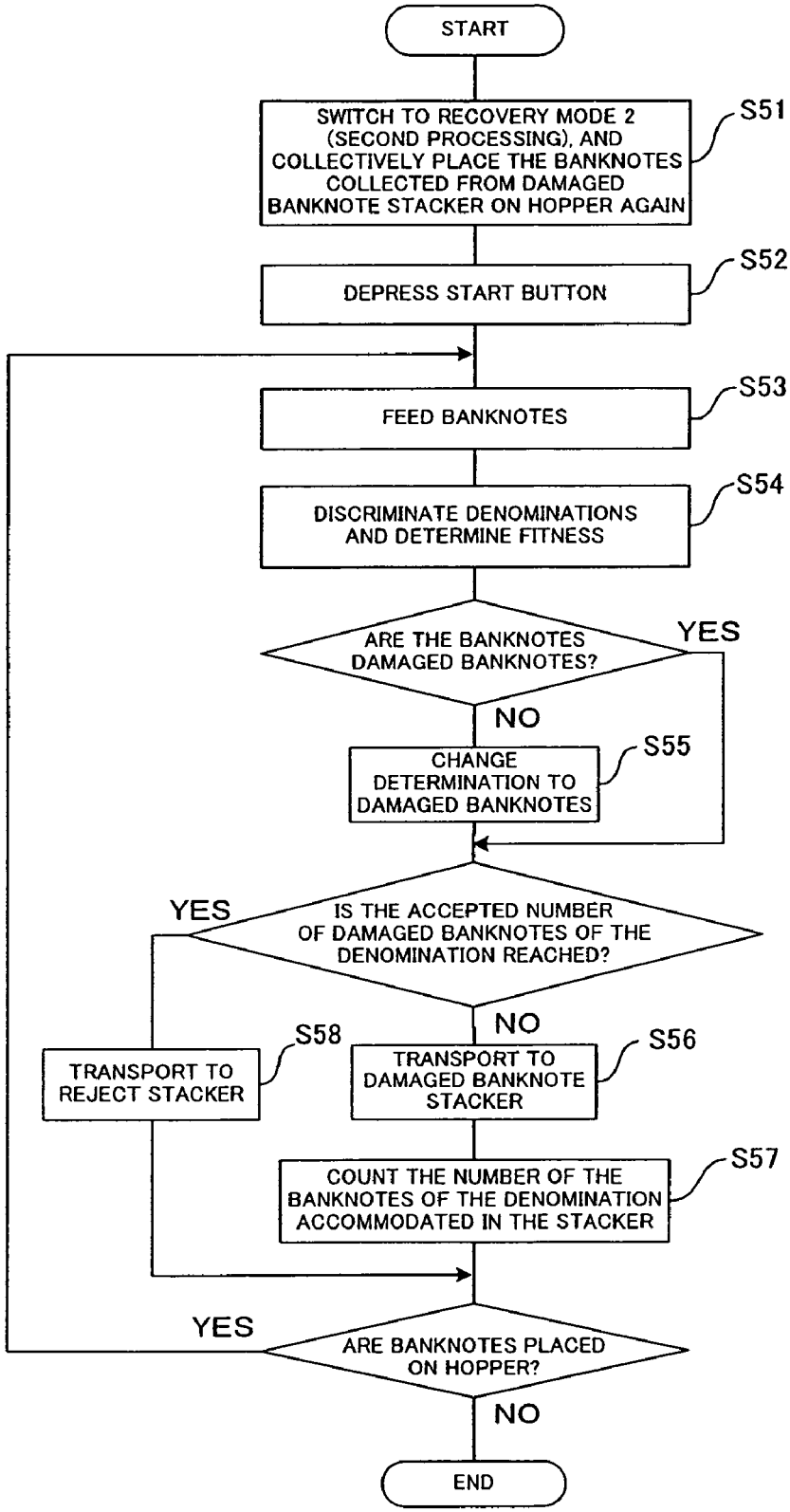
FIG. 8 is a flowchart showing still another embodiment (second processing) of the failure recovery processing according to the present invention.

Next, failure recovery processing is performed (Step S13). When a recovery is successful, it is determined whether the process is to be shifted to the processing of the transaction in which the failure occurs or to the processing of the transaction next to the above transaction, and when the process is to be shifted thereto, the process returns to the Step S7 and repeats the above operation. Note that a procedure of the failure recovery processing at the Step S13 is as shown in FIGS. 6 to 8.

Figure 6:
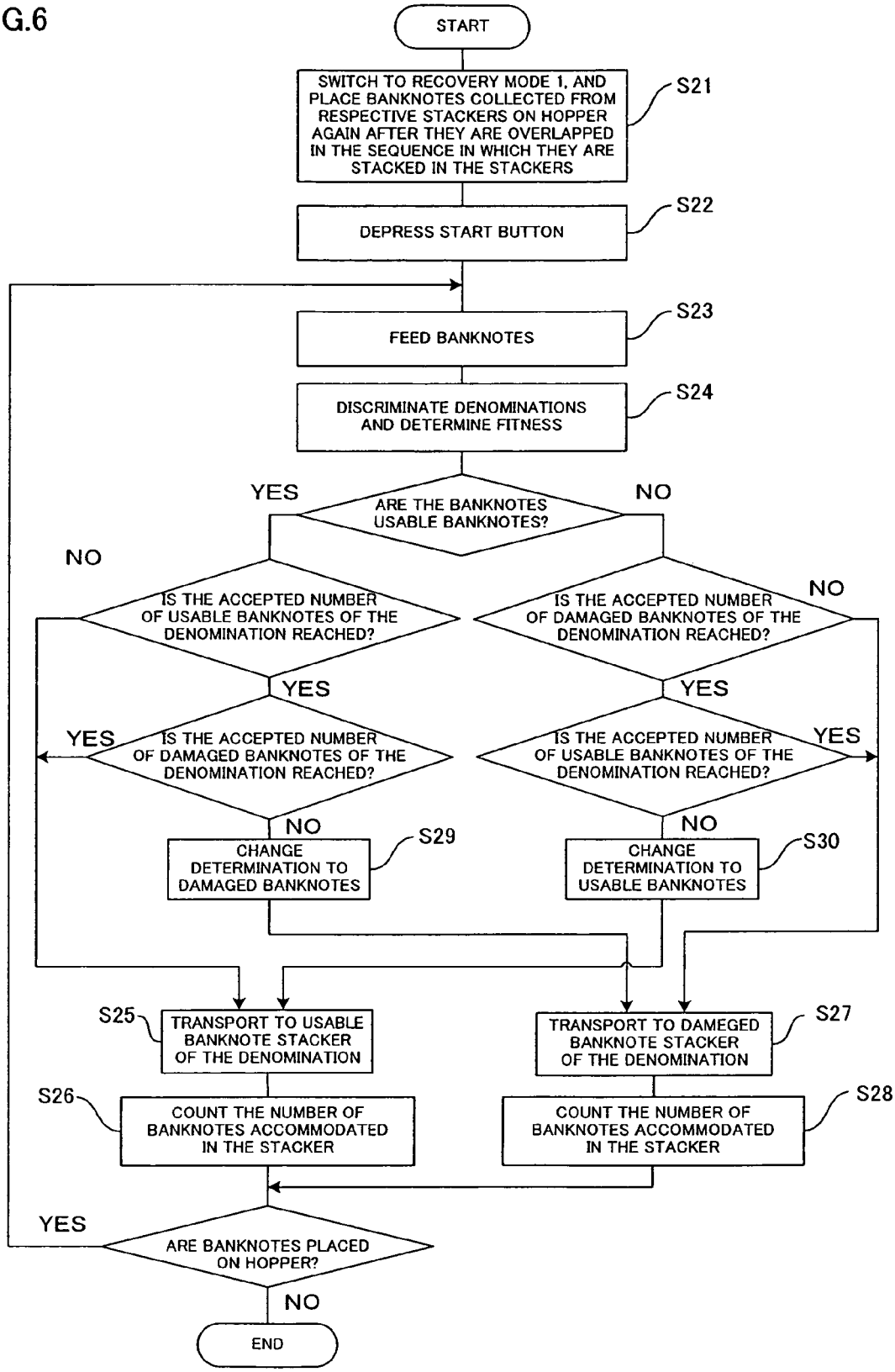
FIG. 6 is a flowchart showing an embodiment of failure recovery processing according to the present invention.

FIG. 6 shows an embodiment of failure recovery processing according to a first invention (Step S13) in detail, which will be explained in detail referring to the drawings.

When a failure such as a jam and the like occurs, it is detected by a jam detection sensor as the failure detection means 44 and informed to the controller 40. The controller 40 sounds the buzzer as the information means 43 to inform the operator of the occurrence of the failure, as well as displays an error code as an alarm output to the liquid crystal display section 21.

When the operator is informed of the occurrence of the jam and the like as the failure and depresses the "MODE" key 244 of the display/operation section 20 (selects a recovery mode 1) as described above, the accepted number displayed to the stacker LED corresponding to the stacker, in which the banknotes whose reception is accepted exist, is changed from a continuously lit state up to that time to a blinking state. The display is switched by the controller 40.

The operator, who is informed of the occurrence of the failure through the buzzer sound and the like, removes the banknotes remaining in the transport paths 18, 18A due to the jam or the like. The operator also removes the banknotes remaining in the hopper without being processed and overlaps all the banknotes, which are accommodated in a stacker 12 whose LED is blinking, in the sequence in which they are stacked without disturbing the sequence and places them on the hopper 11 again (Step S21). Then, the operator depresses the "START/STOP" key 241 of the display/operation section 20 (Step S22), feeds the banknotes to the transport path 18 (Step S23), and discriminates the denominations of the banknotes and determines whether the banknotes are usable or damaged (Step S24).

If the banknotes are usable banknotes, they are transported to and accommodated in a usable banknote stacker of the denomination (Step S25). When the banknotes are accommodated therein, their number is counted to the number of the banknotes accommodated in the stacker (Step S26). Actually, the number obtained by subtracting 1 from the accepted number displayed by the blinking LED 17 of the stacker is displayed. When it is determined at the Step S24 that the banknotes are damaged banknotes, they are accommodated in a damaged banknote stacker of the denomination likewise (Step S27) and counted to the number of the banknotes accommodated in the stacker (Step S28). When the processing is repeated and a usable banknote stacker of any denomination reaches an accepted number faster than the damaged banknote stacker, the display of the LED 17 of the usable banknote stacker displays "0" and is changed from a blinking display to a lit display. When the banknotes, which are the fitness determination processing, are usable banknotes of the denomination, the determination of the banknotes are changed to damaged banknotes (Step S29), the banknotes are accommodated in a damaged banknote stacker of the denomination (Step S27), and the number of the banknotes is added to the number of the banknotes accommodated in the stacker (Step S28). Further, when the banknotes subjected to the determination processing are damaged banknotes of the denomination, they are accommodated in the damaged banknote stacker of the denomination as they are (Step S27), and the number of the banknotes are added to the number of the banknotes accommodated in the stacker (Step S28). When the number of the banknotes accommodated in the usable banknote stacker of the denomination and the number of the banknotes accommodated in the damaged banknote stacker of the denomination reach the accepted numbers together as described above, the banknotes of the denomination processed thereafter are accommodated in the stackers corresponding thereto according to a result of determination performed at the Step S24 to determine fitness, and the numbers of the banknotes are counted to the numbers of the banknotes accommodated in the stackers (Step S26 or S28). At the time, the numerals displayed to the LEDs 17 of the stackers are the number of the banknotes of the receiving transaction which was processed when the failure occurred. When no banknote remains in the hopper by repeating the above processing, the processing is finished.

Note that after the processing is finished, the banknotes, which were left in the transport paths 18, 18A due to the jam and like and removed when the failure occurred, and the banknotes, which remained in the hopper without being processed and removed when the failure occurred, are placed on the hopper again and processed after the operation mode is returned to an ordinary mode. Then, after the number of the banknotes is counted to the number of the banknotes accommodated in the stacker which is recovered from the failure, the operator depresses the "ACCEPT" key 243 and accepts the count data. However, the banknotes which are not processed may be overlapped on all the banknotes accommodated in the stackers 12 and collectively processed at the Step 21.

Example of First Embodiment

A case will be explained in which the received banknote processing apparatus is installed in a cash vault (cash center) of a bank, cash is transported from branches A and B of the bank to the cash vault and subjected to continuous banknote reception processing.

A slip, on which the details of the cash of each denomination are written, is attached to the cash transported from the branch A. When the cash (banknotes) are supplied to the hopper 11 of the received banknote processing apparatus and a START/STOP key is depressed, the processing is started. The banknotes in the hopper 11 are sorted to the respective stackers according to a previously set sort condition and accommodated therein. When the processing of the banknotes of the branch A is finished, the details of the banknotes of each denomination are displayed on a display section of the received banknote processing apparatus. When the displayed contents agreed with the details written on the slip, an "ACCEPT" key is depressed and the count data is accepted.

The received banknote processing apparatus of the present invention includes the fitness determination means, and the banknotes, which passed through the fitness determination means, are sorted to the banknotes which can be reused (usable banknotes) and the banknotes which cannot be reused (damaged banknotes) and gathered, respectively. Fitness of banknote is mainly determined using optical characteristics. However, a banknote whose degree of damage is near to the threshold value of a criterion of the fitness determination is determined to be a usable banknote or a damaged banknote depending on the subtle change of a transport state and the like of it, and thus, a result of determination is not stable. That is, the reproducibility of the fitness determination is not always high.

An example in which the fitness of a banknote of a particular denomination is determined by three steps will be explained as the embodiment of the first invention.

The received banknote processing apparatus has seven stackers, and it is assumed that banknotes are allocated to the stackers under the following conditions.

- First stacker: $20 banknote in the best condition as a first denomination (used for ATM)
- Second stacker: $20 usable banknote in an ordinary condition as a first denomination (used for payment from teller)
- Third stacker: $20 damaged banknote as a first denomination (to be collected by the central bank)
- Fourth stacker: $10 banknote in the best condition as a second denomination+usable banknote in an ordinary condition as a second denomination (for reuse)
- Fifth stacker: $10 damaged banknote as a second denomination (to be collected by the central bank)
- Sixth stacker: $1, $2and5$ mixed usable and damaged banknotes as low value denominations
- Seventh stacker: $50 and $100 mixed usable and damaged banknotes as high value denominations Next, the same processing is repeated to the banknotes transported from the bank branch B. A case in which a jam occurs while the processing is being performed will be explained.

When a transport jam as a failure of the apparatus occurs and is detected by a jam detecting sensor, the apparatus sounds a buzzer to inform the operator of the occurrence of the failure.

The operator, who is informed of the failure of the apparatus by the buzzer sound, removes the banknotes remaining in the hopper 11 and the banknotes remaining on the transport path 18 and gathers them collectively.

Next, the operator takes out all the banknotes in the respective stackers, in which the banknotes of the branches A and B are mixed, gathers them collectively, and supplies them into the hopper. At the time, the banknotes must be placed on the hopper without disturbing the sequence in which the banknotes are stacked on the stackers. Thereafter, when the START/STOP key is depressed, a failure recovery processing is started.

The failure recovery processing is performed as described below.

The denominations of the banknotes supplied to the hopper are discriminated by a denomination discrimination means and whether they are usable banknotes or damaged banknotes is determined by a fitness determination means. Further, the number of the banknotes is counted by a count means, and the banknotes are supplied to the stackers depending on the denominations thereof and on the fitness determination.

Since the apparatus stores the name of the branch A the banknote reception processing of which is accepted and the total number (accepted number) of the banknotes of the respective denominations thereof, the banknotes are supplied to the stackers by the above operation until the accepted number of the banknotes of the branch A is reached so that the accepted number of the branch A is reproduced preferentially. At the time, processing for inverting a result of the fitness determination may be performed to secure the accepted number when a fitness is determined.

Specifically, it is assumed that the accepted banknotes of the branch A are allocated to the stackers as shown in FIG. 1.

First stacker: $20 banknote in the best condition . . . 20 notes

Second stacker: $20 usable banknote in an ordinary condition . . . 10 notes

Third stacker: $20 damaged banknote . . . 30 notes

Fourth stacker: $10 banknote in the best condition+usable banknote in an ordinary state . . . 20 notes Fifth stacker: $10 damaged banknote . . . 10 notes Sixth stacker: $1, $2 and $5 mixed usable and damaged banknotes . . . 30 notes Seventh stacker: $50 and $100 mixed usable and damaged banknotes . . . 20 notes At the time, the respective stackers are sequentially filled with the banknotes depending on the denominations thereof and the determination of fitness, and when, for example, the banknotes in the first stacker reach 20 notes previously, even if there is a banknote which is determined as a $20 banknote in the best condition, processing for regarding it as a $20 usable banknote in an ordinary condition is performed, and banknotes are preferentially accommodated in the second stacker until the banknotes accommodated therein reach 10 notes. Note that when the banknotes accommodated in the first stacker reaches the accepted number, the banknotes accommodated in the third stacker already reach the accepted number and when the banknotes accommodated in the second stacker do not reach the accepted number, even if a banknote fed next is determined a $20 damaged banknote, processing for regarding the $20 damaged banknote as a $20 usable banknote in an ordinary condition is performed, and banknotes are preferentially accommodated in the second stacker until the banknotes accommodated therein reach 10 notes.

Likewise, when the number of the banknotes accommodated in the first and second stackers reach the accepted numbers previously and when the banknotes accommodated in the third stacker do not reach 30 notes, even if a banknote fed next is determined a $20 usable banknote, processing for determining the $20 usable banknote as a $20 damaged banknote is performed and the $20 banknote is accommodated in the third stacker so that recovery processing is preferentially performed. Note that the same processing is performed to the other denominations. After the banknotes of the branch A are recovered to the state before the failure occurs, the banknotes, which are fed and processed thereafter, are accommodated in corresponding stackers according to a result of ordinary determination as the number of the banknotes of the branch B and counted as the banknotes of the branch B.

FIG. 7 shows an embodiment of first processing of the failure recovery processing according to a second invention in detail, and the failure recovery processing will be explained in detail referring to the drawings. The failure recovery processing according to the second invention is divided into two processing stages, and FIG. 7 explains a first processing stage, and FIG. 8 explains a second processing stage.

Note that the second embodiment is different from the first embodiment in that the damaged banknote stackers are independently installed to the respective denominations in the first embodiment, whereas only one damaged banknote stacker is installed commonly to all the denominations in the second embodiment.

The operator, who is informed of the occurrence of a failure by a buzzer sound and the like, selects a recovery mode 2 (first processing stage) by the "MODE" key 244 of the display/operation section 20 and removes the banknotes remaining on the transport paths 18, 18A due to a jam and the like and the unprocessed banknotes remaining in the hopper (they are removed from the banknotes to be processed). The operator takes out all the banknotes accommodated in a usable banknote stacker 12 whose LED is blinked and places them on the hopper 11 again collectively (Step S41). Then, the "START/STOP" key 241 of the display/operation section 20 is depressed (Step S42), the banknotes are fed to the transport path 18 (Step S43), and the denominations of the banknotes are discriminated and fitness is determined (Step S44).

If the banknotes are usable banknotes, they are transported to and accommodated in the usable banknote stackers of the denominations (Step S46). When they are accommodated in the stackers, the number of the banknotes accommodated in each stacker is counted (Step S47). Actually, "1" is subtracted from the accepted number displayed by the blinking LED 17 of the stacker and a resultant accepted number is displayed. When the banknotes are determined as damaged banknotes at the Step S44, the banknotes, which are determined as the damaged banknotes, are changed to usable banknotes (Step S45) and accommodated in the usable banknote stackers of the denominations (Step S46), and the number of the banknotes in each stacker is counted to the number of the banknotes accommodated in the stacker (Step S47). When the banknotes in the usable banknote stacker of any one of the denominations reaches the accepted number by repeating the processing (at the time, the LED 17 of the usable banknote stacker displays "0" and is changed from a blinking display to a lit display) and the denomination of the banknotes, which are subjected to the denomination discrimination processing and the determination processing for determining the fitness, is the same as that of the banknotes reached to the accepted number, the banknotes are transported to the reject stacker 13 regardless of the result of the fitness determination (Step S48). Whereas, when the denomination of the banknotes is different from that of the banknotes reached to the accepted number and the banknotes are determined as usable banknote, they are transported to and accommodated in the usable banknote stackers of the denominations (Step S46). Whereas, when they are determined as damaged banknotes, the banknotes, which are determined as the damaged banknotes, are changed to usable banknotes (Step S45) and accommodated in the usable banknote stackers of the denominations (Step S46), and the number of the banknotes in each stacker is counted to the number of the banknotes accommodated in the stacker (Step S47).

Next, the second processing stage will be explained based on FIG. 8.

When the recovery of the usable banknote stackers of all the denominations is finished as described above, the operator selects the recovery mode 2 (second processing stage) by the "MODE" key 244 of the display/operation section 20, takes out all the banknotes accommodated in the damaged banknote stacker in which the damaged banknotes of all the denominations are accommodated, and collectively places them on the hopper 11 again (Step S51). The operator depresses the "START/STOP" key 241 of the display/operation section 20 (Step S52), feeds the banknotes onto the transport path 18 (Step S53), and discriminates denominations thereof and determines fitness (Step S54).

If the banknotes are the damaged banknotes, they are transported to and accommodated in the damaged banknote stacker (Step S56). When the banknotes are accommodated in the damaged banknote stacker, they are counted to the number of the banknotes of the denomination accommodated in the damaged stacker (Step S57). When the banknotes are determined as the usable banknotes at the Step S54, the banknotes, which are determined as the usable banknotes, are changed to damaged banknotes (Step S55), accommodated in the damaged banknote stacker (Step S56), and counted to the number of the banknotes of the denomination accommodated in the damaged banknote stacker (Step S57).

When the processing is repeated and the banknotes of any one of denominations reaches the accepted number and the banknotes, which are subjected to the denomination discrimination processing and the determination processing for determining the fitness, have the same denomination as that of the banknotes, which reach the accepted number, they are transported to the reject stacker 13 regardless of the result of the fitness determination (Step S58). Whereas, when the denomination of the banknotes is different from that of the banknotes reached to the accepted number and the banknotes are determined as the damaged banknotes, they are transported to and accommodated in the damaged banknote stacker (Step S56). Whereas when the banknotes are determined as the usable banknotes, the banknotes, which are determined as the usable banknotes, are changed to the damaged banknotes (Step S55), accommodated in the damaged banknote stacker (Step S56), and counted to the number of the banknotes of the denomination accommodated in the damaged banknote stacker (Step S57).

When the accepted numbers of the damaged banknotes of all the denominations are reached as described above, the recovery of the damaged banknote stacker is finished.

Example of Second Embodiment

In the example, banknotes are allocated to seven stackers as described below.

First stacker: $1 usable banknote
Second stacker: 5$ usable banknote
Third stacker: $10 usable banknote
Fourth stacker: $20 usable banknote
Fifth stacker: $50 usable banknote
Sixth stacker: $100 usable banknote
Seventh stacker: denomination-mixed damaged banknotes The second invention is characterized in that damaged banknotes are accommodated collectively in the same stacker regardless of the denominations thereof.

In the embodiment, a recovery processing manipulation is divided into two processing stages. Initially, a first processing stage is performed to collect the banknotes in a first stacker to a sixth stacker and to supply them to a hopper again, and a second processing stage is performed to supply the damaged banknotes in a seventh stacker to the hopper again.

In the first processing state, when banknotes are determined as, for example, $10 usable banknotes, they are accommodated in the third stacker as they are, whereas when they are determined as $10 damaged banknotes, processing, which changes the banknotes, which are determined as the $10 damaged banknote, to $10 usable banknote, is performed, and the banknotes are accommodated in the third stacker. When the accepted number of banknotes accommodated in the third stacker is reached as described above, all the $10 banknotes fed thereafter are transported to the reject stacker 13 regardless of the result of the fitness determination.

When the recovery of the first to sixth stackers is completed as described above, the first processing stage is finished.

Next, the operator places the denomination-mixed damaged banknotes collected from the seventh stacker on the hopper 11 and performs the second processing stage.

The fed banknotes are subjected to the denomination discrimination processing and the fitness determination processing. However, the banknotes are entirely transported to and accommodated in the seventh stacker as damaged banknotes until the accepted numbers of the denominations thereof are reached regardless of a result of the fitness determination, and the banknotes exceeding the accepted number are transported to the reject stacker. When, for example, the accepted number of $10 damaged banknotes is 10 notes, the initial 10 notes of the $10 banknotes are entirely transported to the seventh stacker as damaged banknotes regardless of a result of the fitness determination, and the $10 banknotes fed thereafter are entirely transported to the reject stacker regardless of a result of the fitness determination. The processing is finished when the accepted numbers of all the denominations are reached and no banknote remains in the hopper 11.

Note that although the denominations of the banknotes are set to the six types in the example, the number of the denominations may be arbitrarily set, and the stackers may be provided according to the number of the denominations.

The invention claimed is:

1. A received banknote processing apparatus for performing banknote reception processing by sequentially separating and feeding one by one banknotes of each banknote receiving transaction which are placed on a hopper, the received banknote processing apparatus comprising:

a denomination discrimination means for discriminating a denomination of each of the banknotes;

a fitness determination means for determining whether each of the banknotes is a usable banknote or a damaged banknote as a fitness of the banknotes;

a count means for counting a number of the banknotes having the respective discriminated denominations, a number of the banknotes which are determined as usable banknotes, and a number of the banknotes which are determined as damaged banknotes;

a memory means for storing the counted number of the banknotes having the respective discriminated denominations, the counted number of the banknotes which are determined as usable banknotes, and the counted number of the banknotes which are determined as damaged banknotes;

a plurality of stackers for accommodating the banknotes having the respective denominations, the usable banknotes, and the damaged banknotes of the counted banknotes;

a failure detection means for detecting an occurrence of a failure while the banknote reception processing is being performed;

an information means for informing that the occurrence of the failure is detected by the failure detection means;

a failure recovery processing means for recovering numbers of accommodation of banknotes of the stackers to respective numbers of accommodation accepted in the stackers at an end of a last transaction before the failure occurred; and a recovery mode switching means for starting the failure recovery processing means, wherein, when the occurrence of the failure is informed by the information means while banknotes of a second or subsequent banknote receiving transaction are being subjected to the banknote reception processing, the recovery mode switching means starts the failure recovery processing means, the failure recovery processing means, for each denomination, causes the received banknote processing apparatus to sequentially separate and feed one by one all the banknotes placed in sequence from the stackers on the hopper again, causes the denomination discrimination means to discriminate the denominations of the banknotes, causes the fitness determination means to determines the fitness of the banknotes, causes the stackers to accommodate the banknotes being discriminated by denomination and being determined by fitness, and causes the counts means to count the number of the accommodated banknotes, and wherein, when the number of the banknotes being accommodated in any one of the stackers reaches the corresponding counted number of the banknotes being accommodated in the stacker which is stored to the memory means, the failure recovery processing means accommodates the banknotes having the same denomination as the banknotes accommodated in the one stacker in another stacker being allocated to the denomination regardless of a result of the fitness determination; when the number of the banknotes being accommodated in the another stacker reaches the corresponding counted number of the another stacker which is stored to the memory means, the failure recovery processing means subsequently accommodates any remaining banknotes having the same denomination in the stackers for the usable banknotes and the damaged banknotes having the denomination according to the fitness determination; and failure recovery processing is performed by repeating the above processing to all of the denominations.

2. A received banknote processing apparatus according to claim 1, wherein the plurality of stackers includes three stackers which are assigned independently of denomination according to three stages fitness degree.

3. A received banknote processing apparatus according to claim 1, wherein the plurality of stackers includes three stackers, a first of the stackers being assigned to a usable banknote having a particular denomination, a second of the stackers being assigned to a damaged banknote having the particular denomination, and a third of the stackers being assigned to a mix of usable and damaged banknotes having denominations other than the particular denomination.

4. A received banknote processing apparatus according to claim 1, wherein the plurality of stackers includes seven stackers, three of the stackers being assigned respectively to banknotes which have a first denomination according to the three stages of fitness degree, a fourth of the stackers being assigned to a usable banknote having a second denomination, a fifth of the stackers being assigned to a damaged banknote having the second denomination, a sixth of the stackers being assigned to a mix of usable and damaged banknotes having a low-value domination excluding the first and second denominations, and a seventh of the stackers being assigned to a mix of usable and damaged banknotes having a high-value domination excluding the first and second denominations.

5. A received banknote processing apparatus for performing banknote reception processing by sequentially separating and feeding one by one banknotes of each banknote receiving transaction which are placed on a hopper, the received banknote processing apparatus comprising:

a denomination discrimination means for discriminating a denominations of each of the banknotes;

a fitness determination means for determining whether each of the banknotes is a usable banknote or a damaged banknote as a fitness of the banknotes;

a count means for counting a number of the banknotes having the respective discriminated denominations, a number of the banknotes which are determined as usable banknotes, and a number of the banknotes which are determined as damaged banknotes;

a memory means for storing the counted number of the banknotes having the respective discriminated denominations, the counted number of the banknotes which are determined as the usable banknotes, and the counted number of the banknotes which are determined as damaged banknotes;

a plurality of usable banknote stackers disposed for respective denominations;

single damaged banknote stacker for accommodating only damaged banknotes of all denominations;

a reject stacker for accommodating banknotes which are rejected under a predetermined condition;

a failure detection means for detecting an occurrence of a failure while the banknote reception processing is being performed;

an information means for informing that the occurrence of the failure is detected by the failure detection means;

a failure recovery processing means for recovering numbers of banknotes accommodated in the usable banknote stackers and the damaged banknote stacker to respective numbers of accommodation accepted in the stackers at an end of a last transaction before the failure occurred; and a recovery mode switching means for starting the failure recovery processing means;

wherein, when the occurrence of the failure is informed by the information means while the banknotes of a second or subsequent banknote receiving transaction are being subjected to the banknote reception processing, the recovery mode switching means starts the failure recovery processing means, the failure recovery processing means, for each denomination causes the received banknote processing apparatus to sequentially separate and feed one by one all the banknotes placed in sequence from the usable banknote stackers on the hopper again, causes the denomination means to discriminate the denominations of the banknotes, causes the fitness determination means to determine the fitness of the banknotes, causes the usable banknote stackers to accommodate the banknotes being determined by denominations according to the respective denominations as the usable banknotes regardless of a result of the fitness determination, and causes the count means to counts the number of the accommodated banknotes, wherein, when the number of the banknotes accommodated in the usable banknote stacker of any one of the denominations reaches the corresponding counted number of the banknotes accommodated in the usable banknote stacker which is stored to the memory means, the failure recovery processing means performs first processing to all the banknotes placed again causing the reject stacker to accommodate the banknotes having the same denomination as the banknotes whose number reaches the corresponding counted number regardless of a result of the fitness determination, wherein, after the first processing, when all the banknotes accommodated in the damaged banknote stacker are collectively placed again on the hopper, the failure recovery processing means causes the received banknote processing apparatus to sequentially separate and feed one by one all the banknotes placed on the hopper again, causes the denomination discrimination means to discriminate the denominations of the banknotes, causes the fitness determination means to determine the fitness of the banknotes, causes the damaged banknote stacker to accommodate the banknotes as the damaged banknotes regardless of a result of the fitness determination, and cause the count means to count the number of the accommodated banknotes of the respective denominations, and wherein, when the numbers of the banknotes accommodated in the damaged banknote stacker reaches the corresponding counted numbers, which are stored to the memory means, of the damaged banknotes of the respective denominations accommodated in the damaged banknote stacker, the failure recovery processing means performs second processing to accommodate the banknotes having the same denomination as the denomination of the banknotes whose number reaches the corresponding counted number in the reject stacker regardless of a result of the fitness determination to thereby perform failure recovery processing.

6. The received banknote processing apparatus according to claim 1, further comprising a display/operation section including a stacker LED for each stacker, the stacker LED for displaying the number of the banknotes accommodated in the respective stacker, wherein when the failure recovery processing means is started, the counted number, which is stored to the memory means, of the banknotes displayed on the stacker LED is changed from a continuously lit display to a blinking display and the counted number of the banknotes is displayed after subtracting the number of the banknotes accommodated in the stacker placed again on the hopper.

7. The received banknote processing apparatus according to claim 2, further comprising a display/operation section including a stacker LED for each stacker, the stacker LED for displaying the number of the banknotes accommodated in the respective stacker, wherein when the failure recovery processing means is started, the counted number, which is stored to the memory means, of the banknotes displayed on the stacker LED is changed from a continuously lit display to a blinking display and the counted number of the banknotes is displayed after subtracting the number of the banknotes accommodated in the stacker placed again on the hopper.

8. The received banknote processing apparatus according to claim 3, further comprising a display/operation section including a stacker LED for each stacker, the stacker LED for displaying the number of the banknotes accommodated in the respective stacker, wherein when the failure recovery processing means is started, the counted number, which is stored to the memory means, of the banknotes displayed on the stacker LED is changed from a continuously lit display to a blinking display and the counted number of the banknotes is displayed after subtracting the number of the banknotes accommodated in the stacker placed again on the hopper.

9. The received banknote processing apparatus according to claim 4, further comprising a display/operation section including a stacker LED for each stacker, the stacker LED for displaying the number of the banknotes accommodated in the respective stacker, wherein when the failure recovery processing means is started, the counted number, which is stored to the memory means, of the banknotes displayed on the stacker LED is changed from a continuously lit display to a blinking display and the counted number of the banknotes is displayed after subtracting the number of the banknotes accommodated in the stacker placed again on the hopper.

10. The received banknote processing apparatus according to claim 5, further comprising a display/operation section including a stacker LED for each stacker, the stacker LED for displaying the number of the banknotes accommodated in the respective stacker, wherein when the failure recovery processing means is started, the counted number, which is stored to the memory means, of the banknotes displayed on the stacker LED is changed from a continuously lit display to a blinking display and the counted number of the banknotes is displayed after subtracting the number of the banknotes accommodated in the stacker placed again on the hopper.

* * * * *